US010395567B2

(12) United States Patent
Harter

(10) Patent No.: US 10,395,567 B2
(45) Date of Patent: Aug. 27, 2019

(54) TRAFFIC SIGN COVER

(71) Applicant: Michael R. Harter, Pass Christian, MS (US)

(72) Inventor: Michael R. Harter, Pass Christian, MS (US)

( * ) Notice: Subject to any disclaimer, the term of this patent is extended or adjusted under 35 U.S.C. 154(b) by 0 days.

(21) Appl. No.: 15/476,545

(22) Filed: Mar. 31, 2017

(65) Prior Publication Data

US 2017/0287368 A1 Oct. 5, 2017

Related U.S. Application Data

(60) Provisional application No. 62/316,394, filed on Mar. 31, 2016.

(51) Int. Cl.

| | |
|---|---|
| ***G09F 7/18*** | (2006.01) |
| ***G09F 7/10*** | (2006.01) |
| ***E01F 9/00*** | (2016.01) |

(52) U.S. Cl.

CPC ..... *G09F 7/18* (2013.01); *E01F 9/00* (2013.01); *G09F 7/10* (2013.01); *G09F 2007/1843* (2013.01); *G09F 2007/1847* (2013.01); *G09F 2007/1878* (2013.01)

(58) Field of Classification Search

CPC ..... G09F 7/18; G09F 7/10; G09F 2007/1843; G09F 2007/1847; G09F 2007/1878; E01F 9/00

See application file for complete search history.

(56) References Cited

U.S. PATENT DOCUMENTS

| | | | | | |
|---|---|---|---|---|---|
| 1,816,049 | A | * | 7/1931 | Larner | A24F 19/0064 206/37 |
| D156,659 | S | * | 12/1949 | Reed | D8/371 |
| 2,521,641 | A | | 9/1950 | Leander | |
| D162,797 | S | * | 4/1951 | Dubinetz et al. | D19/78 |
| 4,217,713 | A | | 8/1980 | Greenberger | |
| 4,449,310 | A | * | 5/1984 | Kline | A63B 71/0672 206/315.3 |
| 4,765,381 | A | | 8/1988 | Castle | |
| 4,771,560 | A | | 9/1988 | Richards | |
| 4,955,576 | A | * | 9/1990 | Moberg | B60N 3/005 248/229.16 |
| D331,076 | S | * | 11/1992 | Montgomery | D19/88 |
| 5,184,375 | A | * | 2/1993 | Hoyt | A47B 97/02 224/247 |
| 5,235,768 | A | | 8/1993 | Eder | |

(Continued)

*Primary Examiner* — Cassandra Davis

(57) ABSTRACT

A traffic sign cover including a planar member having a first and second side and shaped to be place on a side of an existing sign. Holding members project from the sides of the planar member and optionally along a portion of the outer edges. The holding member and first side form a first slot therebetween for receiving and retaining the existing sign. The second holding member and second side form a second slot therebetween for receiving and retaining a temporary sign. The planar member is slideable upon the existing sign until a top receiving feature contacts a top edge of the existing sign, overlaying a side of the existing sign with the planar member. The temporary sign is slideable upon the planar member until a bottom edge contacts a bottom receiving feature of the planar member, overlaying and covering a side of the planar member with a temporary sign.

13 Claims, 16 Drawing Sheets

(56) References Cited

U.S. PATENT DOCUMENTS

| | | | | | |
|---|---|---|---|---|---|
| 5,456,034 | A * | 10/1995 | Lewis | A47F 5/0869 | 24/336 |
| 5,511,332 | A | 4/1996 | Sturkie | | |
| 5,624,027 | A * | 4/1997 | Ayers | G11B 33/0416 | 206/307 |
| 5,727,696 | A * | 3/1998 | Valiulis | A47F 1/126 | 211/51 |
| 6,148,555 | A | 11/2000 | Beauchamp | | |
| 6,209,598 | B1 | 4/2001 | Petrey | | |
| 6,308,447 | B1 | 10/2001 | Tress | | |
| D509,544 | S | 9/2005 | Nickels | | |
| 7,458,176 | B1 | 12/2008 | Schnabel | | |
| 2006/0053670 | A1 * | 3/2006 | Wiltfang | G09F 3/204 | 40/661.03 |
| 2006/0059756 | A1 * | 3/2006 | Wells | G09F 3/20 | 40/654.01 |

* cited by examiner

TRAFFIC SIGN COVER

This application claims the benefit of U.S. Provisional Patent Application No. 62/316,394, filed Mar. 31, 2016, the entirety of which is hereby incorporated herein by reference in its entirety.

FIELD

Embodiments of the present disclosure pertain to covers for traffic-control signage, and in particular embodiments to covers which may be installed over an existing traffic sign and can optionally retain a temporary traffic sign, such as a temporary traffic sign with information different than the original sign.

BACKGROUND

The transportation industry, specifically highway improvement projects, requires the installation of traffic control measures in order to safely perform the work under construction. The majority of these projects are conducted under the oversight of the Federal Highway Administration, State Transportation Agency, and/or Local Public Agency. In most cases, under the oversight of these agencies, highway improvement projects require the alteration of existing traffic signage by means of removal or covering. Removal and replacement is both costly and time consuming, and not a practical or common method. Covering existing traffic signage is the most common method. However, it was realized by the inventor(s) of this disclosure that a number of inadequate methods are currently being used such as bagging with geotextile, trash bags, covering with plywood, or covering with similarly sized sign.

When using a trash or plastic bag to cover a traffic sign temporarily, the bag generally is secured to the sign with industrial tape, such as duct tape. This method generally does not withstand the various environmental conditions. Over time only a partially shrouded sign and duct tape is all that is left of the sign covering. When using plywood to cover a sign, the plywood is generally secured with a bolt driven through both the sign and the plywood and secured with a washer and nut on the rear side of the traffic sign. Over time plywood tends to warp and crack when untreated and exposed to the various environmental conditions. When the plywood breaks down the bolt may no longer secure the plywood to the sign and the plywood may fall to the ground or only partially cover the sign. When using a similarity sized temporary sign to cover an original sign, the temporary sign is generally bolted to the original sign and oriented so that the insignia sides of the each sign are coupled together leaving the back side of the temporary sign exposed, with either a blank surface or temporary insignia. This method leaves the original sign damaged by the holes used to bolt the two signs together.

The inventor(s) have realized there is a need for a traffic sign cover and covering method that is resistant to the environmental conditions, with nondestructive installation, easy to install, and made with durable light weight material. The present disclosure is directed to such an endeavor and others as described herein.

SUMMARY

The present disclosure may comprise one or more of the features recited in the attached claims, and/or one or more of the following features and combinations thereof.

Embodiments of the present disclosure provide an improved traffic sign cover and methods for attaching a sign cover to an existing road sign.

In one aspect, an illustrative traffic sign cover includes a planar member having a first side, a second side, a top edge, a bottom edge, and opposite vertical edges. The planar member may be sized and shaped to cover a side of an existing sign. A first holding member (e.g., pair of guides or brackets) projecting from the first side of the planar member along a portion of each respective opposite vertical edge may form a first pair of slots between the guides and the first side for receiving and retaining the existing sign. A top flange projecting from the first side along a portion of a top edge and a bottom flange projecting from the second side along a portion of the bottom edge may also be included.

The first side of the planar member can be positioned facing a side of the existing sign to be covered, the first slots receiving and retaining the existing sign against the first side of the planar member. The planar member can be slideable downward upon the existing sign until the flange contacts a top edge of the existing sign, overlaying and covering a side of the existing sign with the planar member.

The second holding member (e.g., pair of guides or brackets) can project from the second side of the planar member along a portion of each respective opposite vertical edge. The second pair of guides and the second side can form a second pair of slots therebetween for receiving and retaining a temporary sign. A bottom flange projecting from the second side of the planar member along a portion of the bottom edge can be used to secure the bottom edge of a temporary sign. The second slots can receive and retain the temporary sign against the second side of the planar member. The temporary sign can be moved (e.g., slid) downward until a bottom edge of the temporary sign contacts the bottom flange, overlaying and covering the planar member with the temporary sign.

In an alternative aspect, an illustrative traffic sign cover includes a planar member having a first and second side, and being sized and shaped to cover a side of an existing sign. A pair of guides are optionally attached to slots, which may be located on vertical edges of the cover, to form a first pair of guides on the first side of the cover and a second pair of guides on the second side of the cover. The first pair of guides project from the first side of the planar member along a portion of each respective edge, the first pair of guides and first side forming a first pair of slots therebetween for receiving and retaining the existing sign. A top flange optionally projecting from the first side along a portion of a top edge can form a slot along the top edge for receiving the top of the existing sign. A bottom flange optionally projecting from the second side along a portion of the bottom edge for receiving the bottom of a replacement sign.

The first side of the planar member can be positioned facing a side of the existing sign to be covered, the first slots receiving and retaining the existing sign against the first side of the planar member. The planar member can be slideable downward upon the existing sign until the flange contacts a top edge of the existing sign, overlaying and covering a side of the existing sign with the planar member.

The second pair of guides project from the second side of the planar member along a portion of each respective opposite vertical edge. The second pair of guides and the second side forms a second pair of slots therebetween for receiving and retaining a temporary sign. The bottom flange projecting from the second side of the planar member along a portion of the bottom edge secures the bottom edge of the temporary sign. The second slots can receive and retain the temporary sign against the second side of the planar member. The temporary sign is slideable downward until a bottoms edge of the temporary sign contacts the bottom flange, overlaying and covering the planar member with the temporary sign.

In an alternative aspect, an illustrative traffic sign cover, includes a planar member having a first side and a second side, the planar member sized and shaped to cover a side of an existing sign. A first holding member (e.g., pocket) is formed adjacent a top portion of the first side of the planar member, the first pocket may receive a top portion of the existing sign, retaining the planar member in a position overlaying and covering a side of the existing sign to be covered. A second holding member (e.g., pocket) is formed adjacent a bottom portion of the second side of the planar member, the second pocket for receiving a bottom portion of a temporary sign, retaining the temporary sign in a position overlaying and covering the second side of the planar member.

In a further alternative aspect, an illustrative traffic sign cover includes a planar member having a first side and a second side, the planar member sized and shaped to cover a side of an existing sign. A first holding member (e.g., pair of guides) can be attached to the first side of the planar member and a second pair of guides can be attached to the second side of the planar member. The first pair of guides may receive a top portion of an existing sign, retaining the planar member in a position overlaying and covering a side of the existing sign to be covered. The second holding member (e.g., pair of guides) may receive a bottom portion of a temporary sign, retaining the temporary sign in a position overlaying and covering the second side of the planar member.

In a further alternative aspect, an illustrative traffic sign cover includes a planar member having a first side and a second side, the planar member sized and shaped to cover a side of an existing sign. On the first side of the cover one or more (e.g., a pair of) holding members (e.g. shallow pocketed clips) are attached to a top portion of the planar member, and a pair of holding members (e.g., deep pocketed clips) are attached to the bottom portion of the planar member. The deep clip can first receive a bottom portion of the existing sign, then the cover can be pushed up vertically until the shallow clips are above the top of the existing sign. When the cover is moved back downward, the inside of the shallow pocketed clips will rest on the edges of a top portion of the sign and retain the planar member in a position overlaying and covering a side of the existing sign. On the second side of the cover an optional one or more (e.g., a pair) of deep pocketed clips can be attached to the top portion of the cover and an optional one or more (e.g., a pair) of shallow pocketed clip can be attached to the bottom portion of the cover. The deep clip can initially receive a top portion of a temporary sign, allowing the temporary sign to be pushed up vertically until the shallow clips are below the bottom of the temporary sign. When the temporary cover is moved downward the edges of the bottom portion of the temporary sign rest on the inside of the shallow clips and retain the temporary sign in a position overlaying and covering the second side of the planar member.

Additional features of the disclosure will become apparent to those skilled in the art upon consideration of the following detailed description of the illustrative embodiment.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DESCRIPTION OF THE ILLUSTRATED EMBODIMENTS

Figure 1:
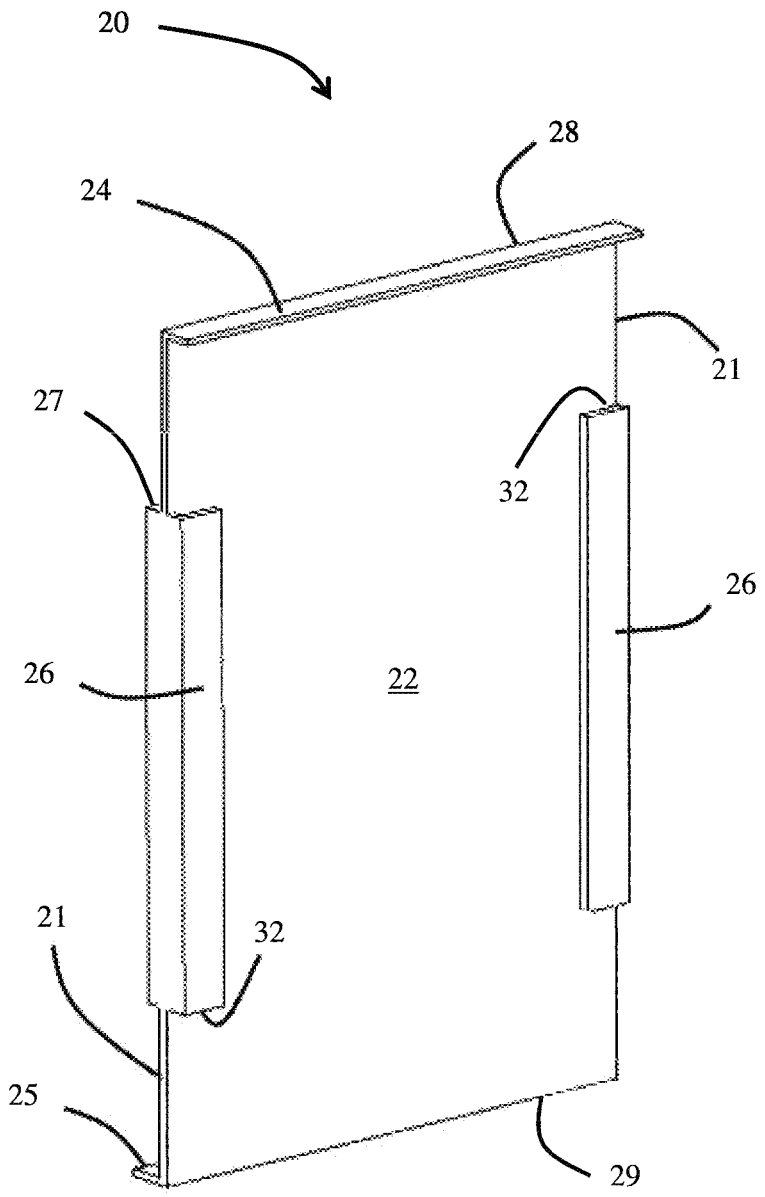
FIG. 1 is a perspective view of a first illustrative traffic sign cover according to one embodiment of the present disclosure.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

The traffic sign cover as described in embodiments herein includes a device that can cover an existing traffic control sign, obstructing it from the view of the travelling public. In addition, the device can provide one or more slots, pockets, clips, etc. in which a temporary sign can be placed and retained. The device can be easily installed by sliding over the top of an existing sign, and will stay in place without the need for additional bolts, fasteners or elastic straps.

Figure 2:
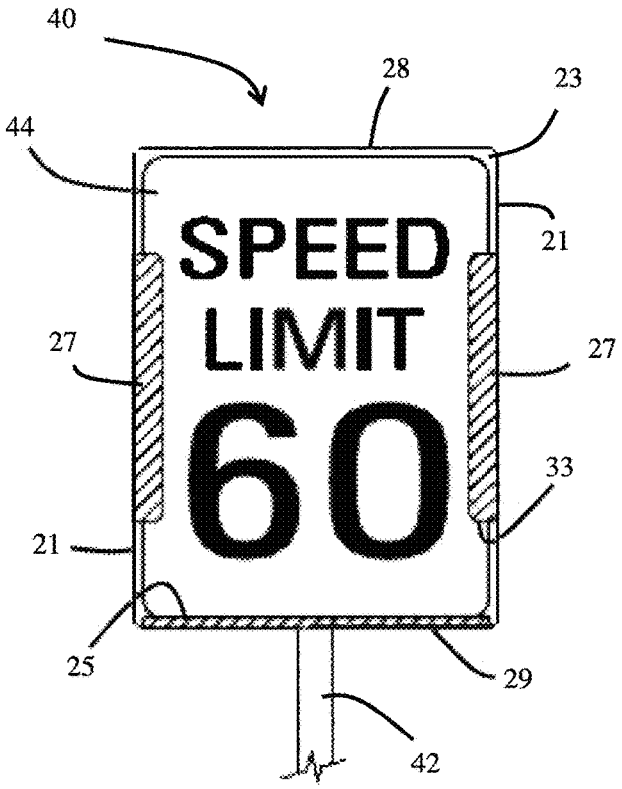
FIG. 2 is a front view of an assembly of the first illustrative traffic sign cover of FIG. 1 shown in place over an existing sign and holding in place a temporary sign.
Figure 3:
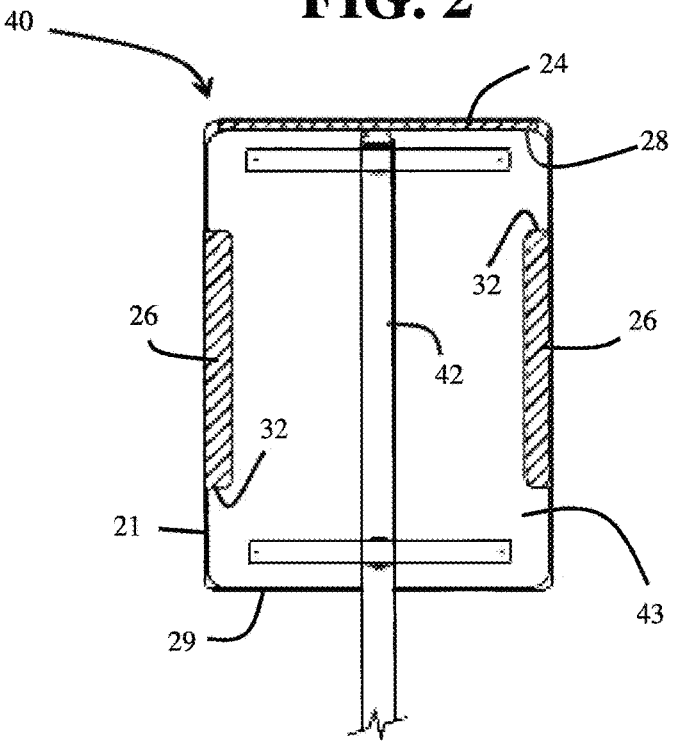
FIG. 3 is a rear view of the assembly of FIG. 2.
Figure 4:
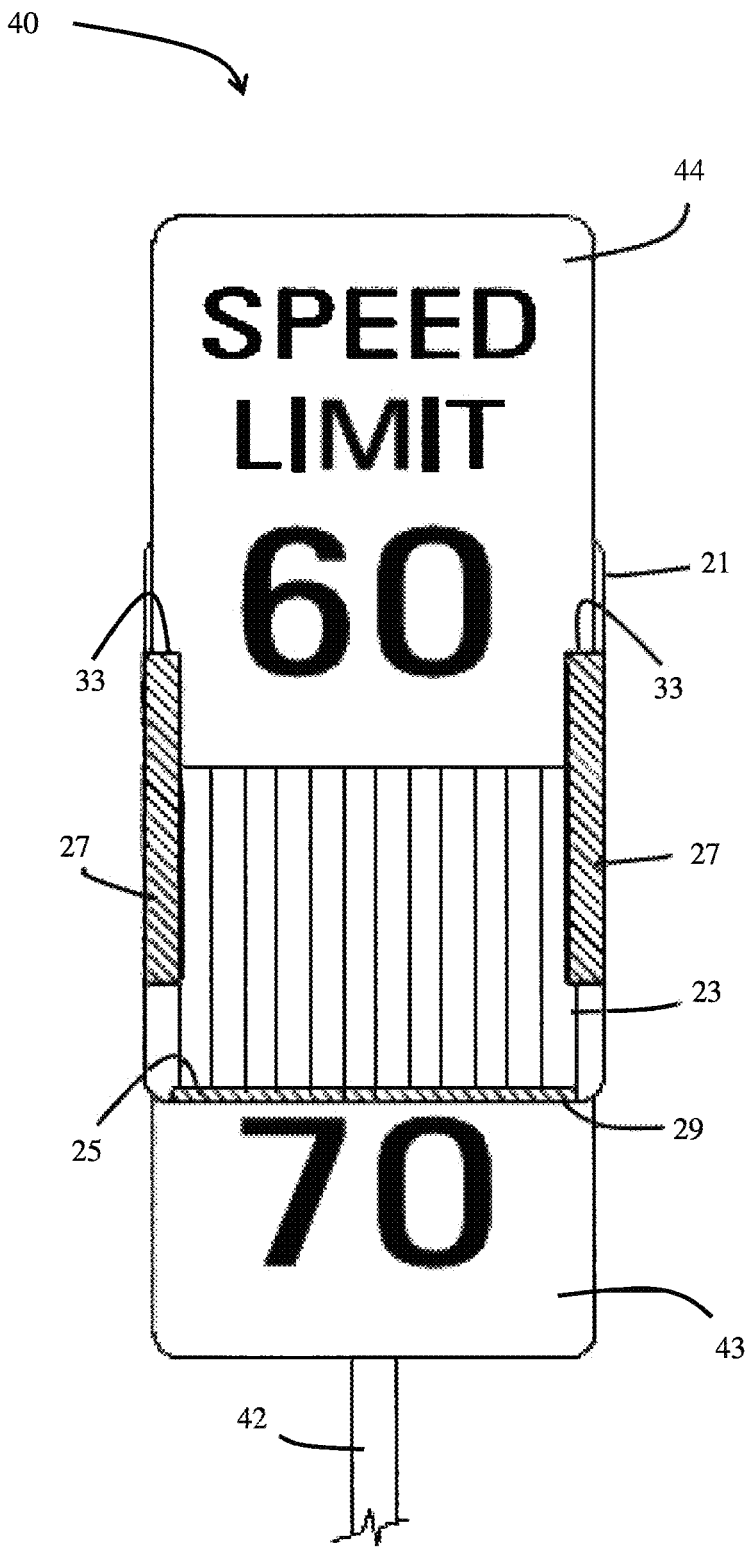
FIG. 4 is a partially assembled front view of the assembly of FIG. 2.
Figure 6:
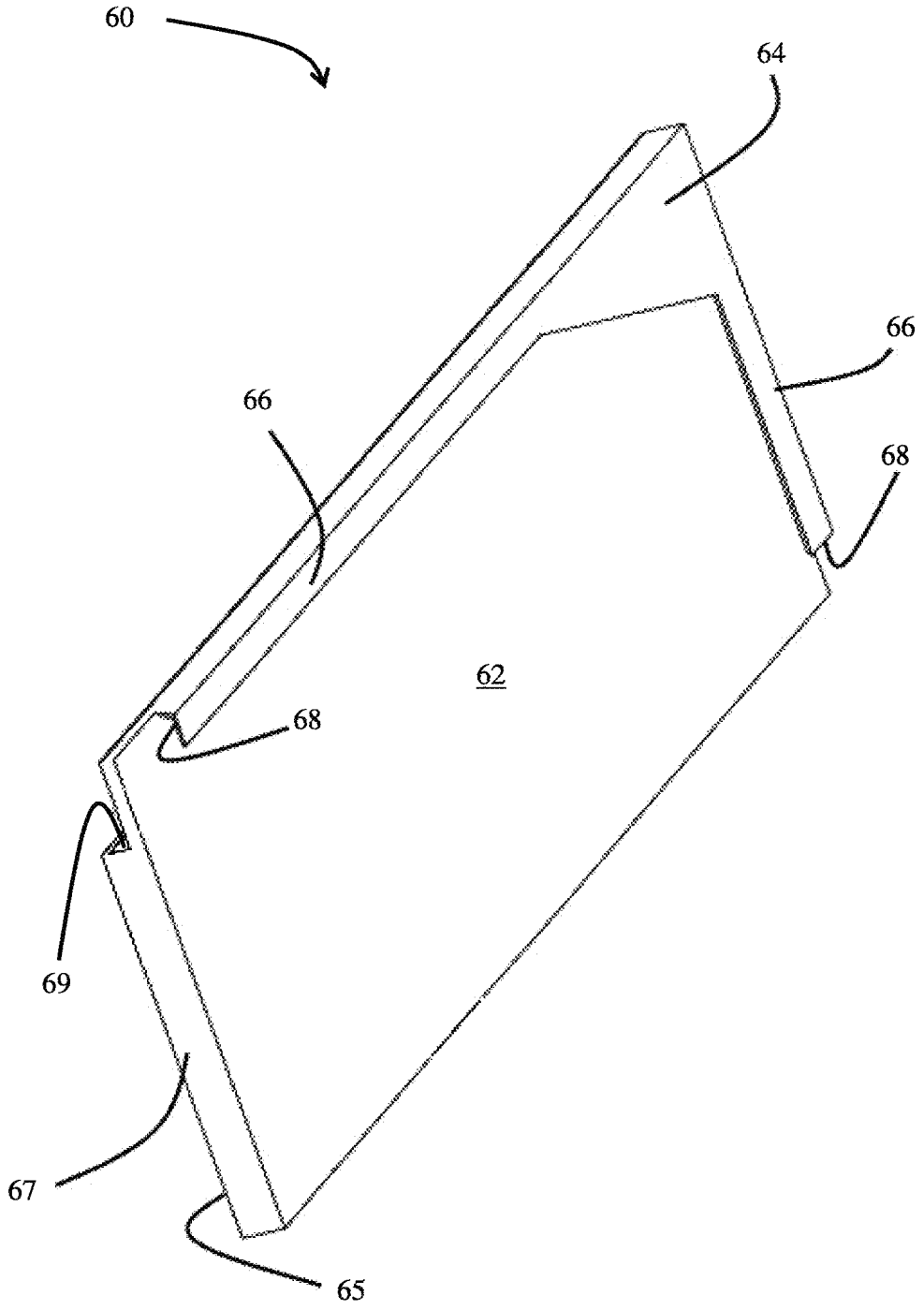
FIG. 6 is a perspective view of a traffic sign cover according to yet another embodiment of the present disclosure.
Figure 7:
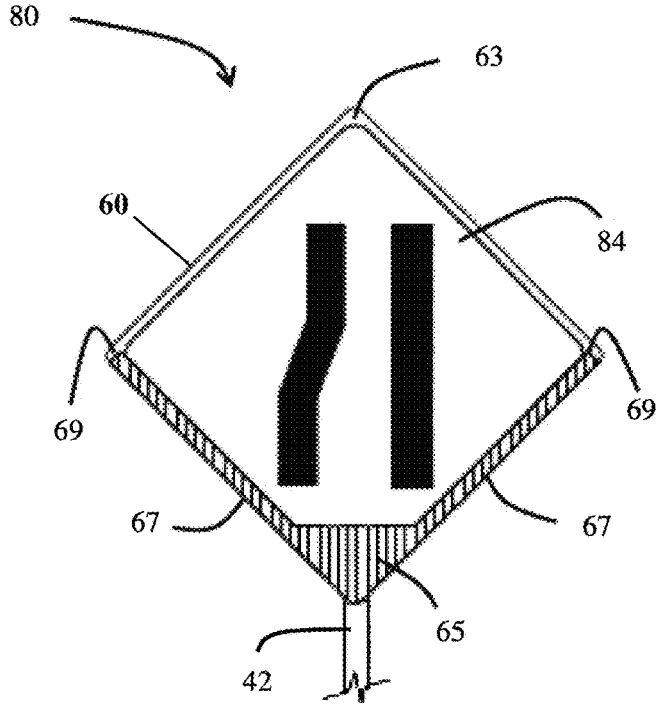
FIG. 7 is a front view of an assembly of the illustrative traffic sign cover of FIG. 6 in place over an existing sign and holding in place a temporary sign.
Figure 8:
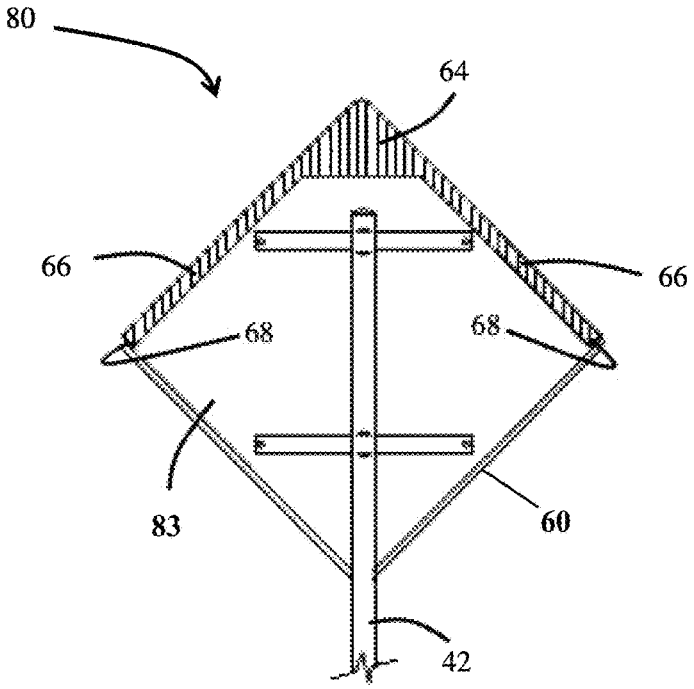
FIG. 8 is a rear view of the assembly of FIG. 7.
Figure 9:
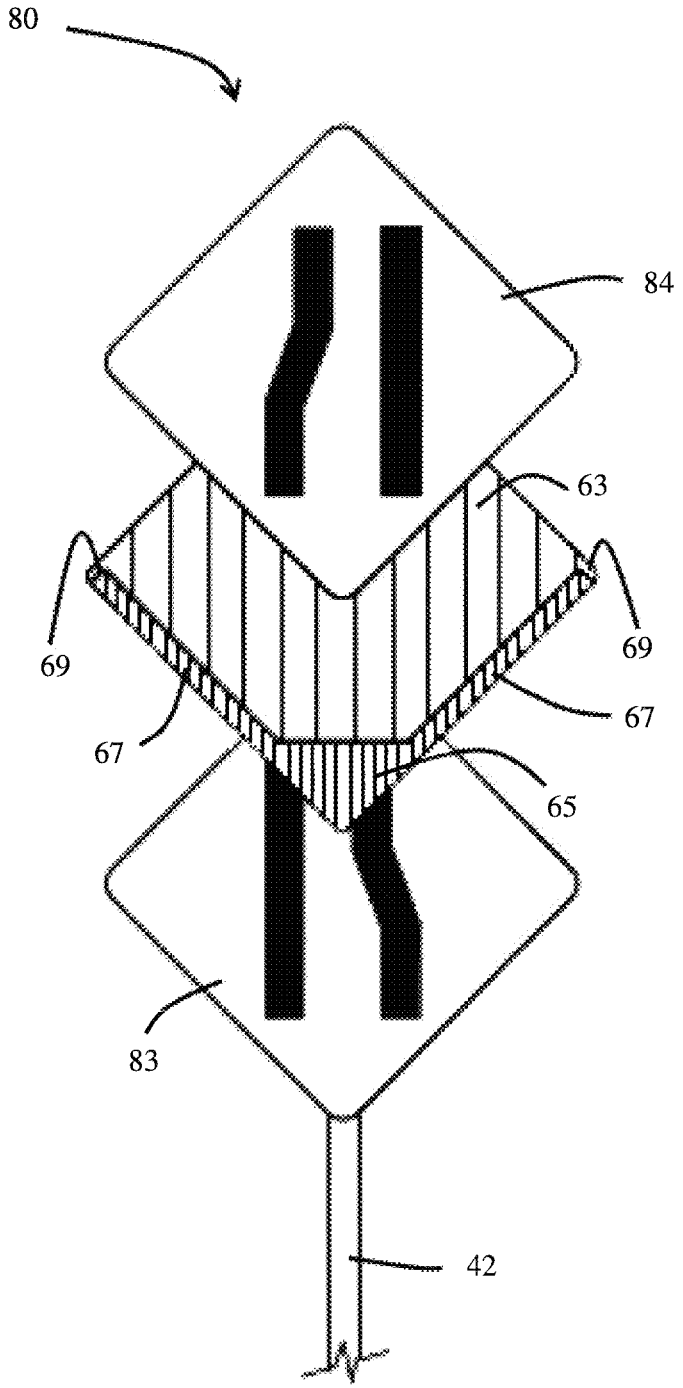
FIG. 9 is a partially assembled front view of the assembly of FIG. 7.

Typical applications for a traffic sign covering device 20 and 60 are shown as assembly 40 in FIGS. 2-4 and assembly 80 in FIGS. 6-9. Each typical application includes an existing standard traffic control sign 43 and 63 as designated in the Manual on Uniform Traffic Control Devices (MUTCD). The signs from the MUTCD were chosen arbitrarily to illustrate the utility of the traffic sign covers. The standard R2-1 sign, is shown in FIGS. 2-4 and the standard W4-2R sign, is shown in FIGS. 7-9. The designations of both the R2-1 and W4-2R are referenced in the current edition of the MUTCD; however, embodiments can be used with signs of other shapes and sizes and signs other than those used for traffic control.

Referring to FIGS. 1-4, one embodiment of a traffic sign cover assembly 40 includes a planar cover 20 having a first side 22, a second side 23, a top flange 24, a bottom flange 25, a first pair of holding members (e.g., guides or brackets 26), and a second pair of holding members (e.g., guides or brackets 27). The cover 20 is sized and shaped to be placed over an existing sign 43. (FIG. 4). In some embodiments, the cover 20 is obscures the existing sign, while in other embodiments the cover 20 may resemble more of a frame that does not (or only partially) obscures the information on the existing sign.

The first guides 26 project from the first side 22 of the cover 20 along at least a portion of each respective opposite vertical edge 21, as shown in FIG. 1. The first guides 26 and first side 22 forming a first space (e.g., slot 32) therebetween for receiving and retaining the existing sign 43. A top flange 24 projects from the first side 22 along a portion of a top edge 28, for example, outward from and perpendicular to the first side 22. The first side 22 of the cover 20 can be positioned facing a side of the existing sign 43 to be covered, and the first slot 32 receives and retains the existing sign 43 against the first side 22 of the cover 20, as shown in FIGS. 2-4. The cover 20 is slideable downward upon the existing sign 43, as shown in FIG. 4, until the top flange 24 contacts the top of the existing sign 43, as shown in FIG. 3, overlaying and covering a side of the existing sign with the cover 20.

The second guides 27, as shown in FIG. 2 project from the second side 23 of cover 20 along a portion of each respective opposite vertical edge 21. The second pair of guides 27 and the second side 23 form a second space (e.g., slot 33) therebetween for receiving and retaining a temporary sign 44. A bottom flange 25 projects from the second side 23 of the cover 20 along a portion of the bottom edge 29, for example, outward from and perpendicular to the second side 23. The second slots 33 can receive and retain the temporary sign 44 against the second side 23 of the cover 20, and the temporary sign 44 may be slideable downward, as shown in FIG. 4, until a bottom edge of the temporary sign contacts the bottom flange 25, overlaying and covering the cover 20 with the temporary sign 44, as shown in FIG. 2.

Figure 5:
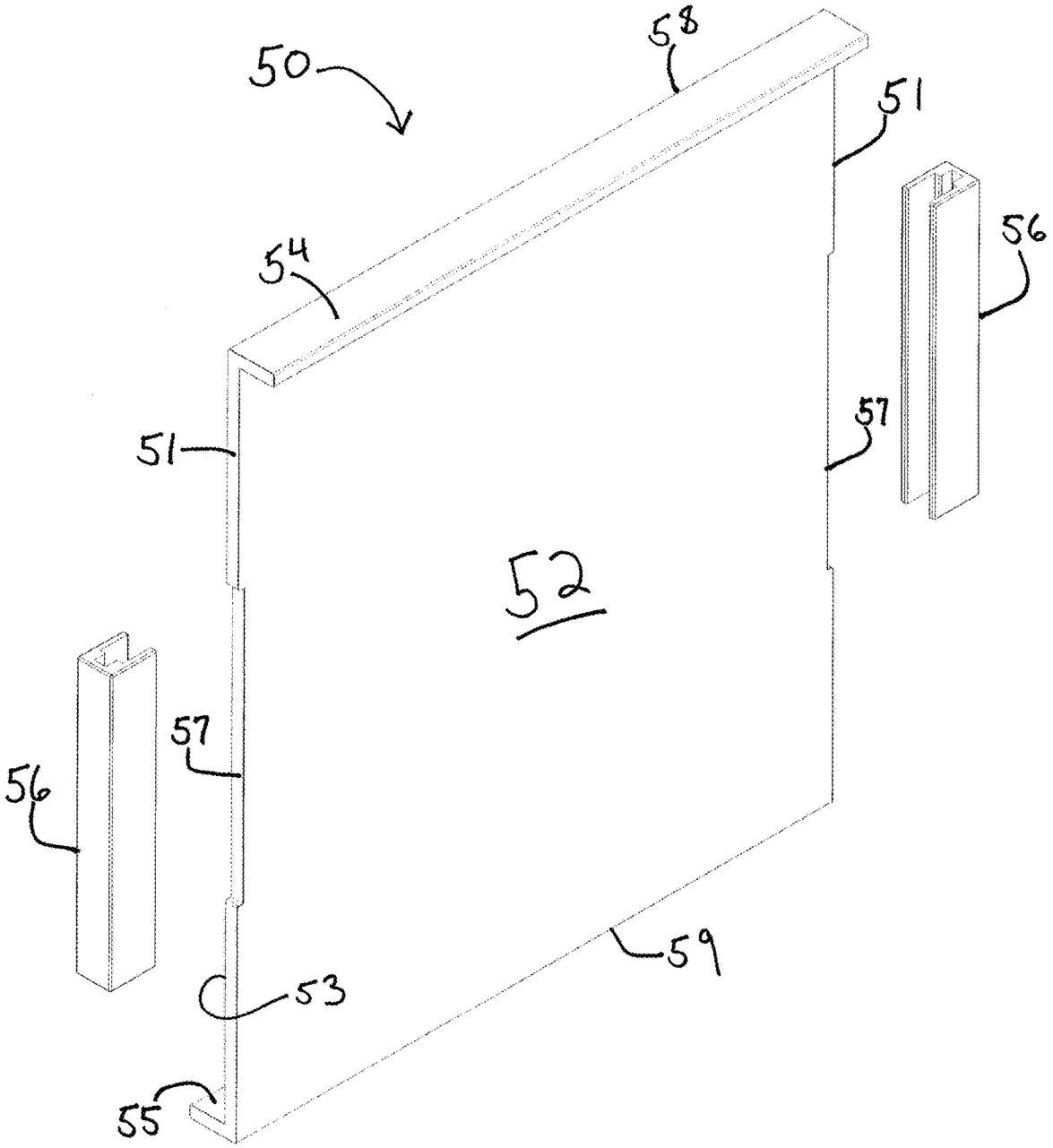
FIG. 5 is a perspective view of a traffic sign cover according to another embodiment of the present disclosure.

While embodiments such as those depicted in FIGS. 1-4 can be of unitary construction, alternative embodiment can be constructed from multiple components, such as the traffic sign cover 50 illustrated in FIG. 5. Cover 50 includes a first side 52, a second side 53, a top flange 54, a bottom flange 55, a pair of holding members (e.g., guides 56), which are attachable to slots 57. The guides 56 may be welded, glued, or secured to slots 57 by other known means. The cover 50 is sized and shaped to cover a side of an existing sign 43 (see, e.g., FIG. 4).

The guides 56 project from both the first side 52 and second side 53 of the cover 50 along at least a portion of each respective opposite vertical edge 51, as shown in FIG. 5. The guides 56 and the first side 52 form a first pair of slots (not shown) therebetween, for receiving and retaining the existing sign 43. A top flange 54 projects from the first side 52 along a portion of a top edge 58, for example, outward from and perpendicular to the first side 52. The first side 52 of the cover 50 can be positioned facing a side of the existing sign 43 to be covered, and the slots receive and retain the existing sign 43 against the first side 52 of the cover 50, similar to FIGS. 2-4. The cover 50 is slideable downward upon the existing sign 43 (see, e.g., FIG. 4) until the top flange 54 contacts the top of the existing sign 43 (see, e.g., FIG. 3) overlaying and covering a side of the existing sign with the cover 50.

The guides 56 and the second side 53 form a second pair of slots therebetween. The second pair of slots may receive and retain a temporary sign 44. The bottom flange 55 projects from the second side 53 of the cover 50 along a portion of the bottom edge 59, for example, outward from and perpendicular to the second side 53. The second slots can receive and retain the temporary sign 44 against the second side 53 of the cover 50, and the temporary sign 44 may be slideable downward, as illustrated in FIG. 4, until a bottom edge of the temporary sign contacts the bottom flange 55, overlaying and covering the cover 50 with the temporary sign 44, as illustrated in FIG. 2.

An alternative embodiment of a traffic sign cover assembly 80 is illustrated if FIGS. 6-9. The assembly includes an alternative cover 60, a first side 62 and second side 63, a top holding member (e.g., pocket 64), a bottom holding member (e.g., pocket 65), a first pair of holding members (e.g., guides 66), and a second pair of holding members (e.g., guides 67). The alternative cover 60 is sized and shaped to cover a side of an existing sign 83, for example, a sign having a corner rather than an edge at the highest point of the sign. The top pocket 64 is formed adjacent a top portion of the first side 62 of the alternative cover 60. The top pocket 64 receives a top portion of an existing sign 83, and the first guides 66 form slots 68 between the first guides 66 and first side 62 for receiving edges of the existing sign 83 adjacent the top portion, as shown in FIG. 8, retaining the alternative cover 60 in a position overlaying and covering a side of the existing sign 83.

The bottom pocket 65 formed adjacent a bottom portion of the second side 63 of the alternative cover 60, the bottom pocket 65 receives a bottom portion of the temporary sign 84, and the second guides 67 form slots 69 between the second guides 67 and the second side 63 for receiving edges of the temporary sign 84 adjacent the bottom portion, as shown in FIGS. 7 and 9, retaining the temporary sign 84 in a position overlaying and covering the second side 63 of the alternative cover 60, as shown in FIG. 7.

Figure 10:
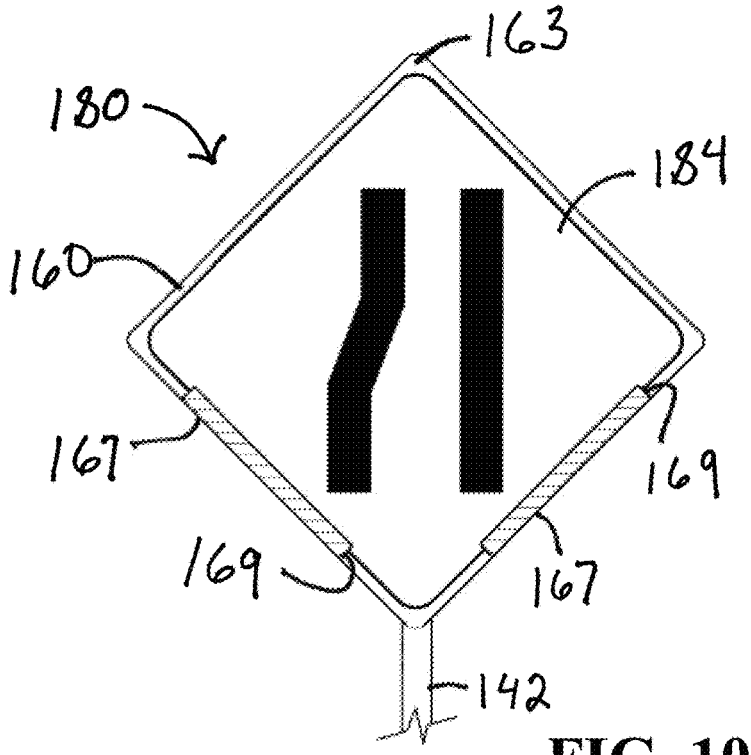
FIG. 10 is a front view of a traffic sign cover in place over an existing sign and holding in place a temporary sign according to yet another embodiment of the present disclosure
Figure 11:
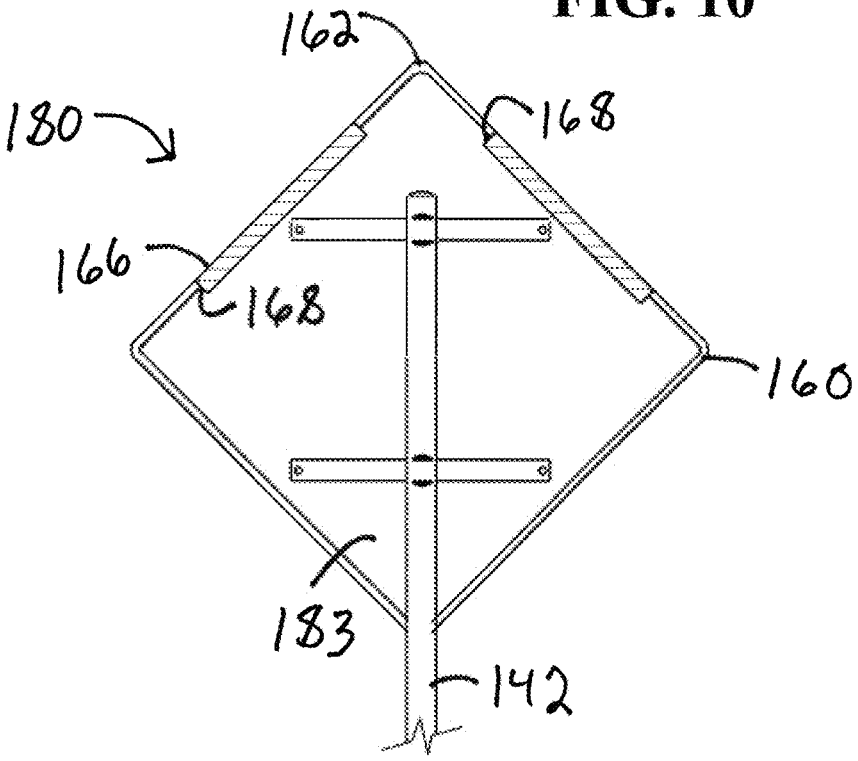
FIG. 11 is a rear view of the assembly of FIG. 10.
Figure 12:
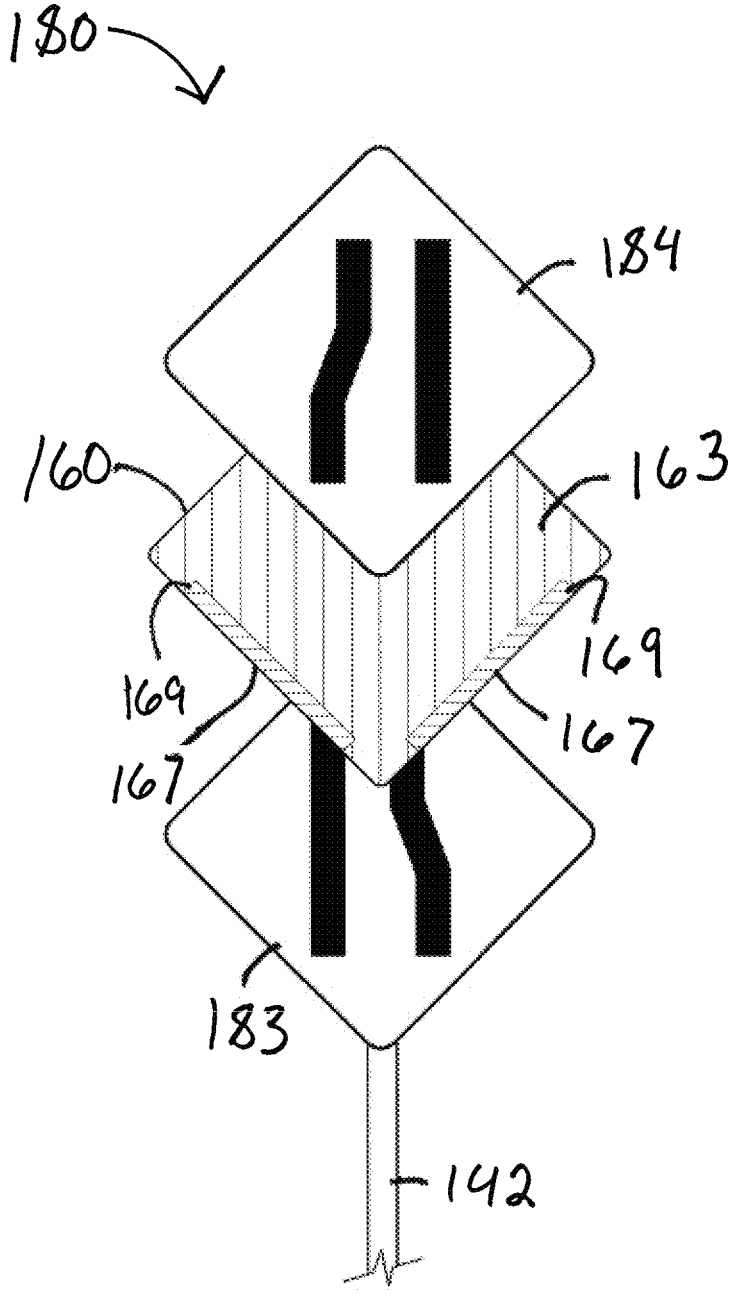
FIG. 12 is a partially assembled front view of the assembly of FIG. 10.

Illustrated in FIGS. 10-12 is a traffic sign cover assembly 180 according to a further embodiment of the present disclosure. The assembly includes an alternative cover 160, a first side 162 and second side 163, a first pair of holding members (e.g., guides 166), and a second pair of holding members (e.g., guides 167), which do not connect to one another at the bottom corner of cover 160 and may have advantages when attaching cover 160 to signs with certain post connections. The alternative cover 160 is sized and shaped to cover a side of an existing sign 183, for example, a sign having a corner rather than an edge at the highest point of the sign. The top guides 166 form spaces (e.g., slots 168) between the first guides 166 and first side 162 for receiving edges of the existing sign 183 adjacent the top portion, as shown in FIG. 11, retaining the alternative cover 160 in a position overlaying and covering a side of the existing sign 183, as shown in FIG. 12.

The second guides 167 form spaces (e.g., slots 169) between the second guides 167 and the second side 163 for receiving edges of the temporary sign 184 adjacent the bottom portion, as shown in FIG. 10, retaining the temporary sign 184 in a position overlaying and covering the second side 163 of the alternative cover 160, as shown in FIG. 12.

Figure 13:
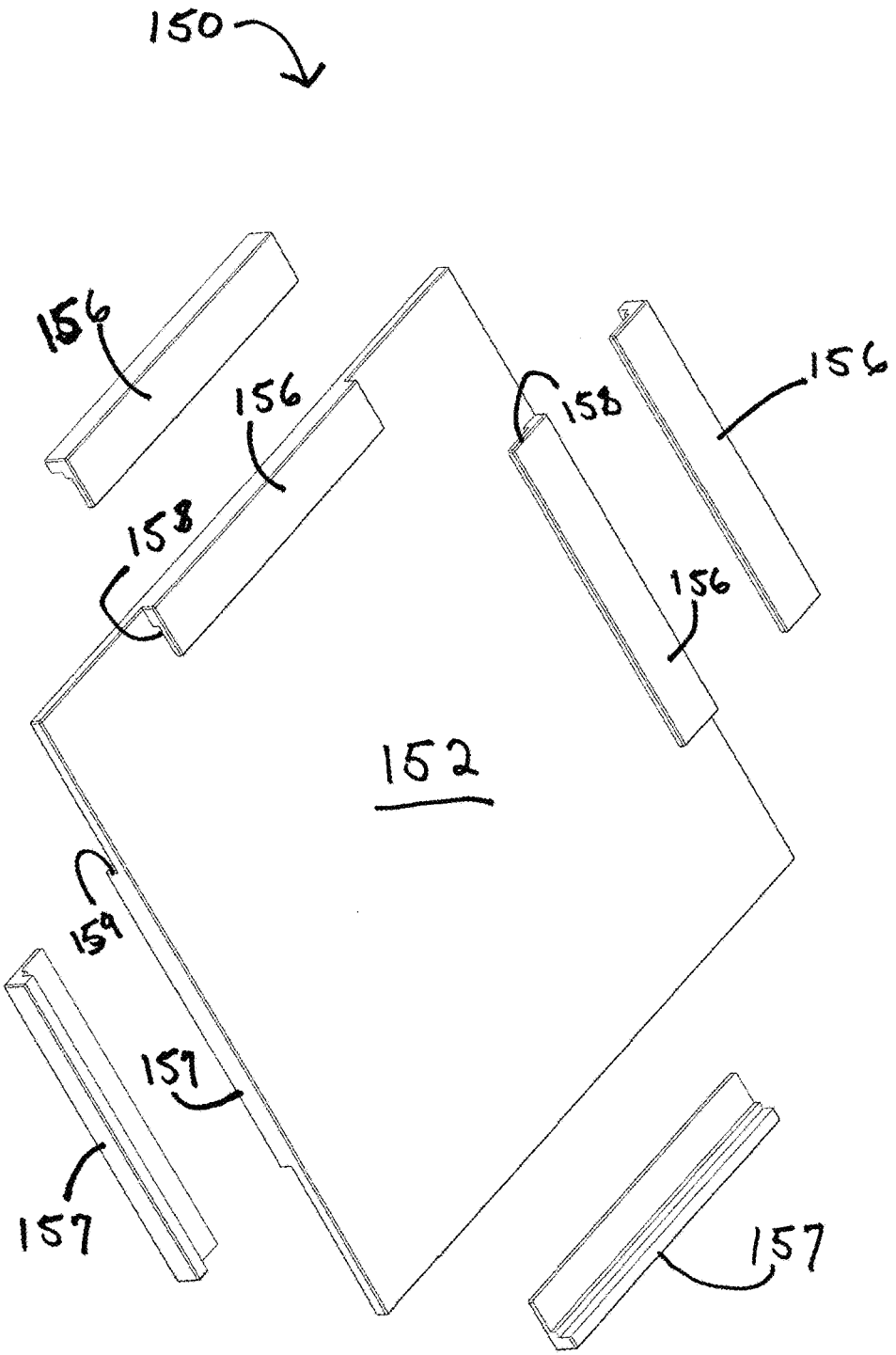
FIG. 13 is a perspective view of a traffic sign cover according to a further embodiment of the present disclosure.
Figure 14:
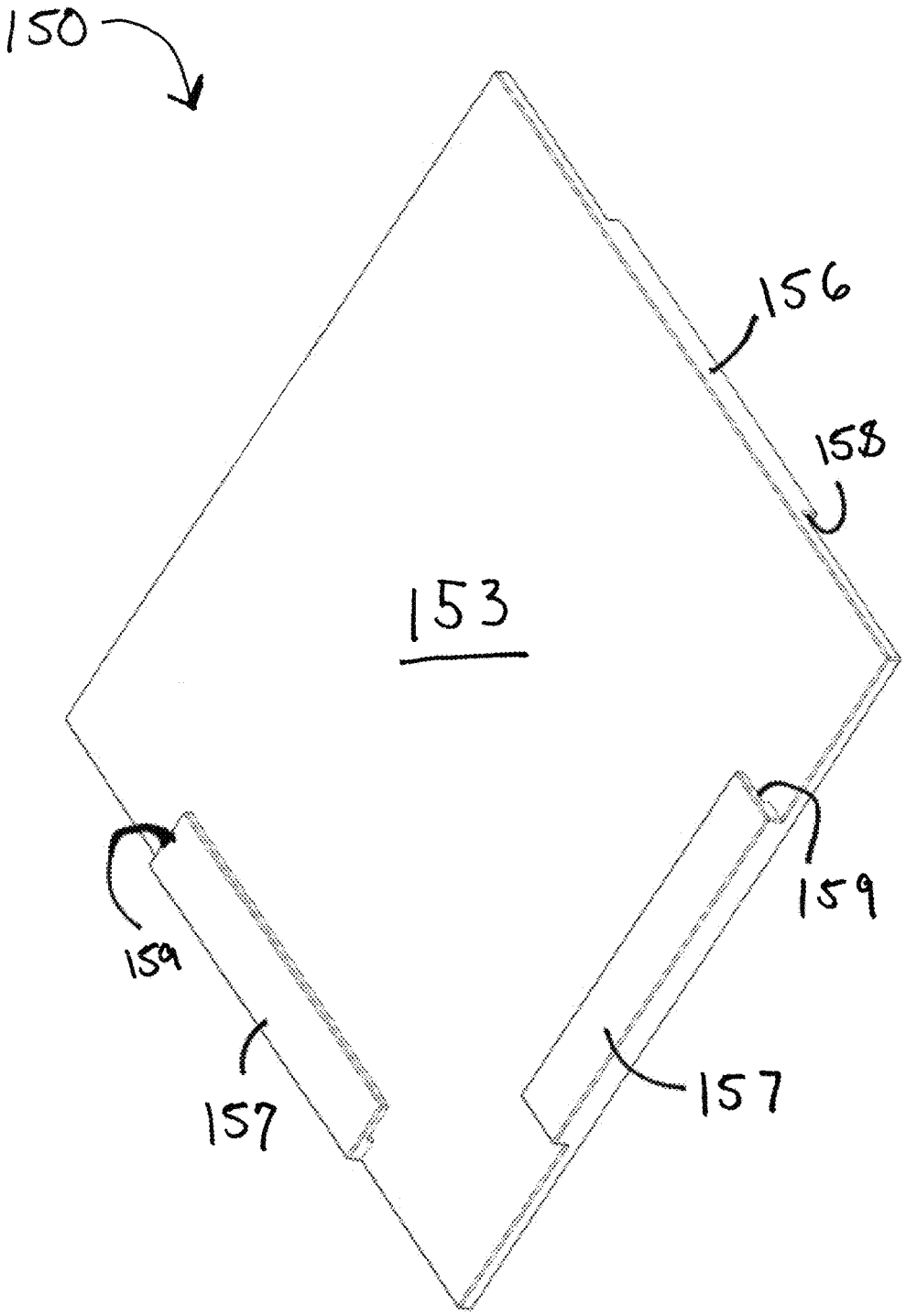
FIG. 14 is a perspective view of a traffic sign cover depicted in FIG. 13.

An alternative embodiment traffic sign cover 150 is illustrated if FIGS. 13-14. The cover 150 includes, a first side 152 and second side 153, a first pair of holding members (e.g., guides 156), and a second pair of holding members (e.g., guides 157). The guides are shown in FIG. 13 both detached from cover 150, and attached to cover 150. The guides 156 and 157 may be welded, glued or secured by other known means to the cover 150. The alternative cover 150 is sized and shaped to cover a side of an existing sign 183, for example, a sign having a corner rather than an edge at the highest point of the sign. The top guides 156 form spaces (e.g., slots 158) between the first guides 156 and first side 152 for receiving edges of the existing sign 183 adjacent the top portion, as illustrated in FIG. 11, retaining the alternative cover 150 in a position overlaying and covering a side of the existing sign 183, as illustrated in FIG. 12.

The second guides 157 form spaces (e.g., slots 159) between the second guides 157 and the second side 153 for receiving edges of the temporary sign 184 adjacent the bottom portion, as illustrated in FIG. 10, retaining the temporary sign 184 in a position overlaying and covering the second side 153 of the alternative cover 150.

Figure 15:
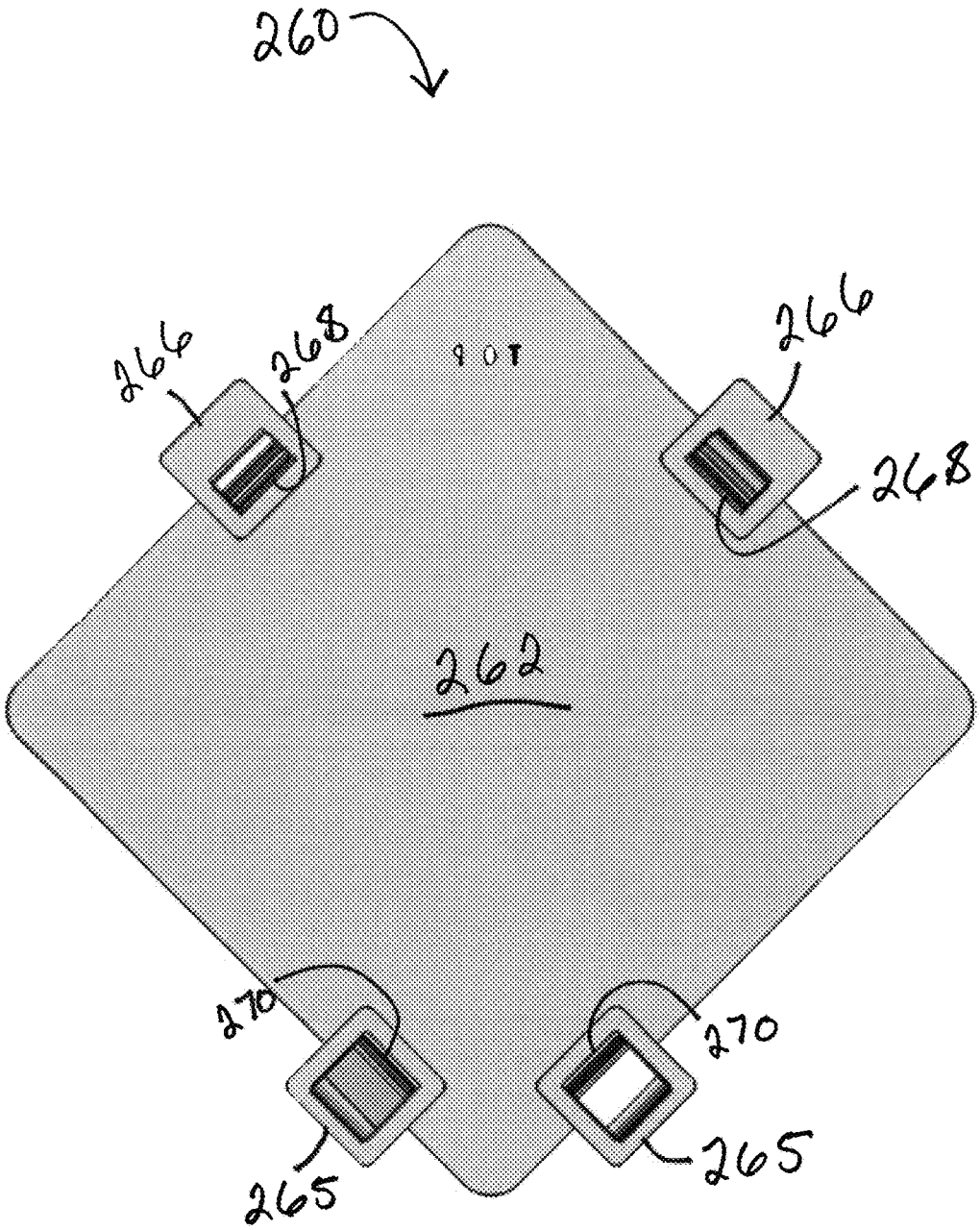
FIG. 15 is a front plan view of a traffic sign cover according to still another embodiment of the present disclosure.
Figure 16:
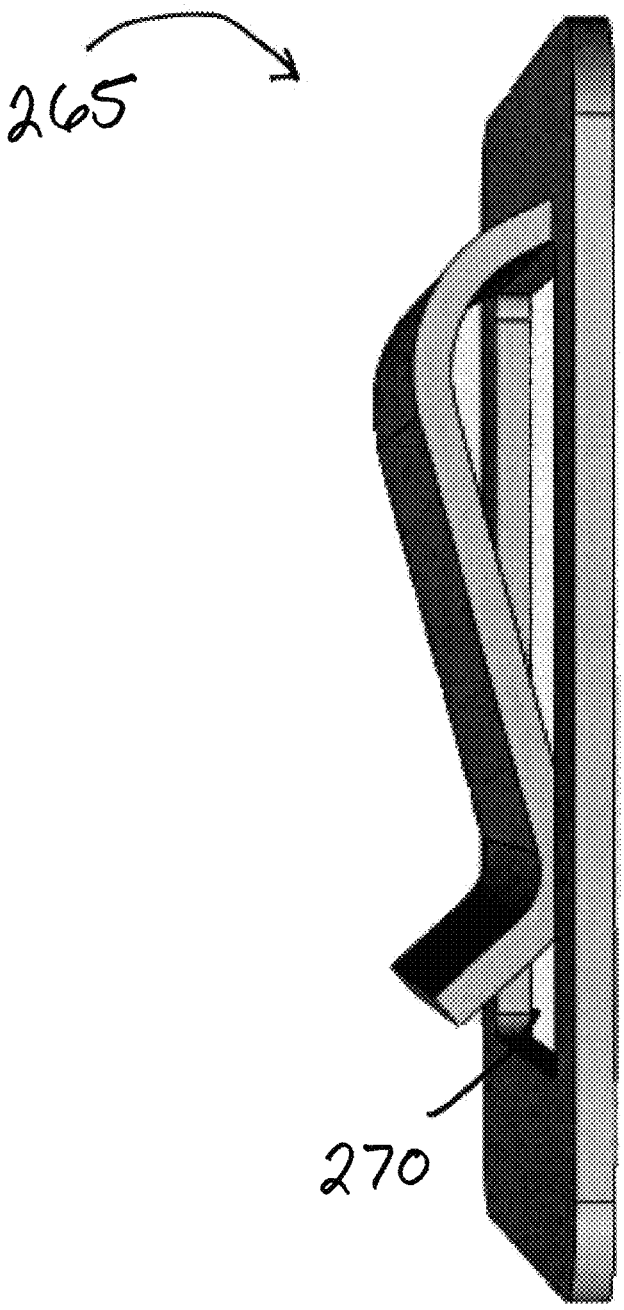
FIG. 16 is a perspective view of an attachment member usable with the traffic sign cover depicted in FIG. 15.

An alternative embodiment of a traffic sign cover 260 is illustrated if FIG. 15. The alternative cover 260 includes a first side 262 and second side 263, one or more (e.g., a first pair) of holding members (e.g. shallow clips 266) attached to a top portion of the cover 260, and one or more (e.g., a first pair) of holding members (e.g., deep clips 265) attached to a bottom portion of cover 260. The alternative cover 260 is sized and shaped to cover a side of an existing sign 183, for example, a sign having a corner rather than an edge at the highest point of the sign. The shallow clips 266 and deep clips 265 (see, e.g., FIG. 16) are attachable to cover 260 by welding, gluing or secured by other known means. The shallow clips 266 attached to top portion of the first side 262 of the cover 260 form spaces (e.g., slots 268) between the shallow clip 266 and first side 262 for receiving top edges of the existing sign 183 adjacent the top portion (not shown). The deep clips 265 attached to bottom portion of the first side 262 of the cover 260 form spaces (e.g., slots 270) between the deep clip 265 and first side 262 for receiving bottom edges of the existing sign 183 adjacent the bottom portion (not shown).

The installation of the cover 260 may include positioning the cover 260 over the existing sign 183 with the deep clips below the bottom edges of the existing sign 183. The cover 260 may then be pushed up so that the bottom deep clips 265 engage the existing sign 183. The cover is pushed further up until the shallow clips 266 are positioned above the top edges of the existing sign 183. The cover 260 is then allowed to move down until the shallow clips 266 rest on the top edges adjacent the top corner of the existing sign 183, retaining the cover 260 in a position overlaying and covering a side of the existing sign 183 (not shown). The shallow clips 266 bear the weight of the cover 260 upon the top edges of the existing sign 183, and the deep clips 265 secure the bottom portion of the cover 260 to the existing sign 183.

Figure 17:
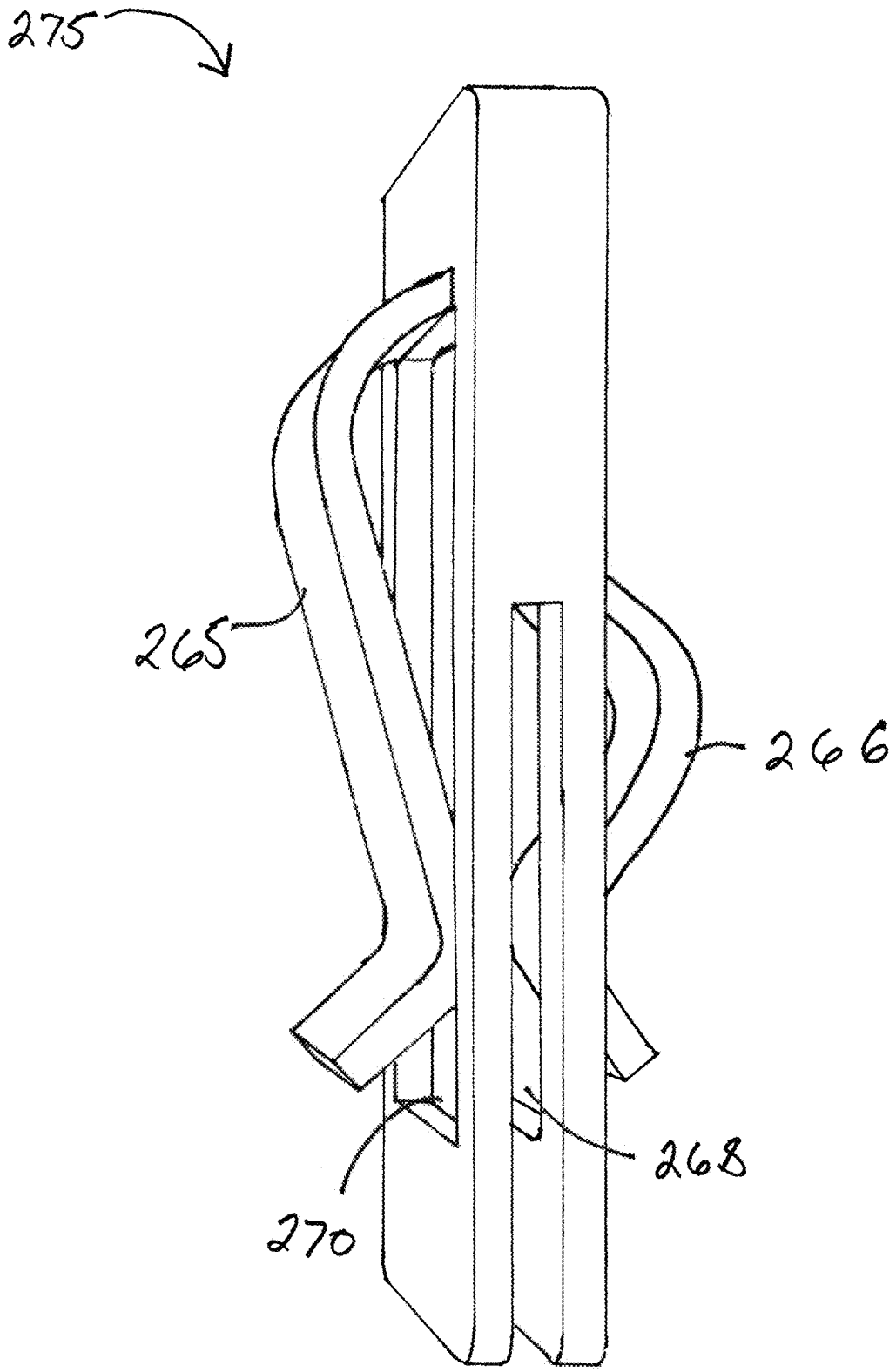
FIG. 17 is a perspective view of another attachment member usable with the traffic sign cover depicted in FIG. 15.
Figure 18:
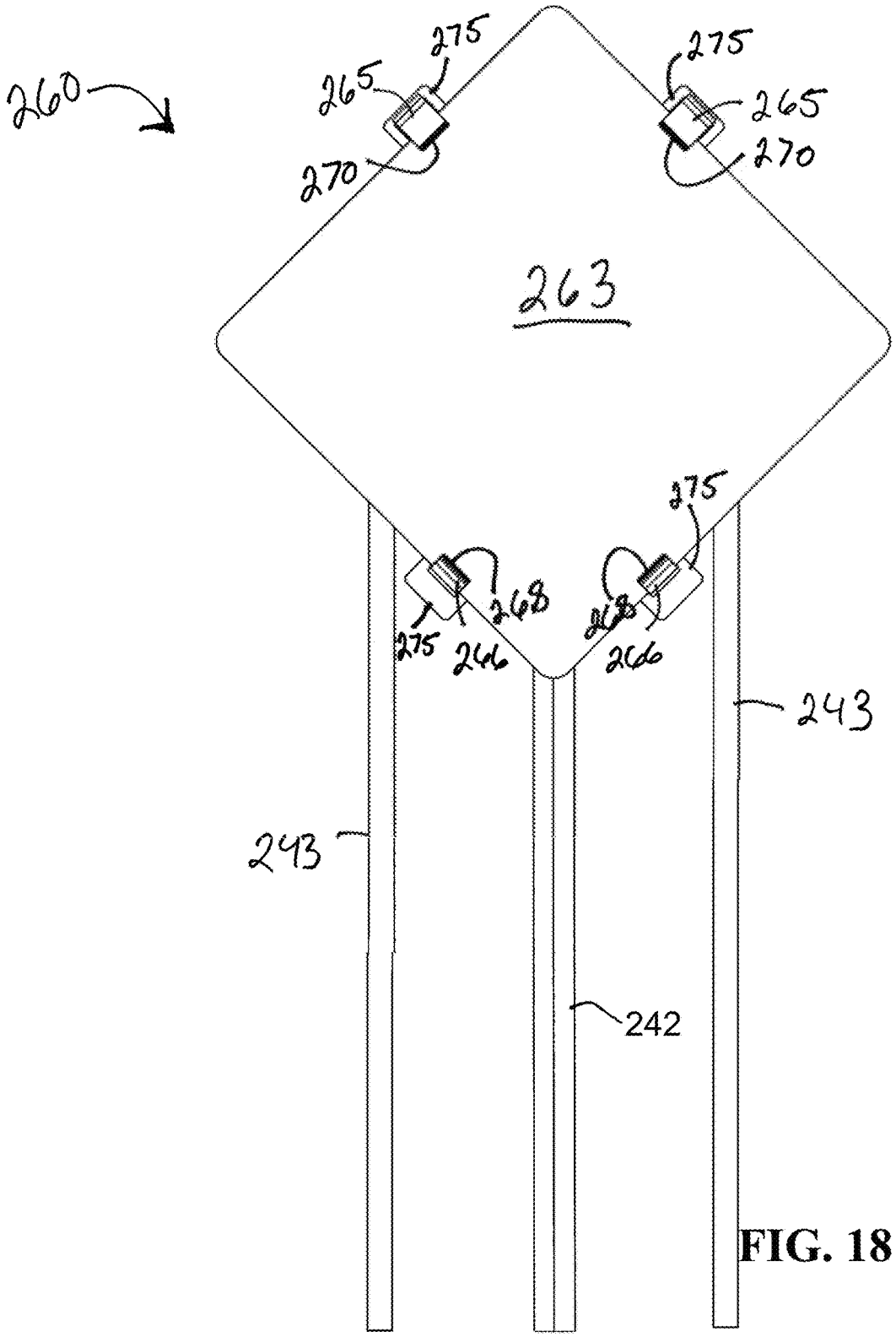
FIG. 18 is a front view of an assembly of the traffic sign cover of FIG. 16 shown in place over an existing sign and capable of holding a temporary sign.

An alternative embodiment of a traffic sign cover 260 is illustrated if FIG. 18. The alternative cover 260 includes a first side 262, a second side 263, and holding members (e.g., clips 275) instead of clips 265 and 266. A first pair of clips 275 can be attached to a top portion of cover 260 and a second pair of clips 275 can be attached to a bottom portion of cover 260. The clips 275 include a deep clip 265 and shallow clip 266 on opposing sides of clip 275 as shown in FIG. 17. The clips 275 are welded, glued or secured to cover 260 by other known means. The first pair of clips attached to the top portion of the cover 260 are oriented so that the deep clip side is positioned on the second side 263 of cover 260 and the shallow clip side is positioned on the first side 262 of cover 260. The second pair of clips are attached to the bottom portion of the cover 260 and oriented such that the deep clip side is positioned on the first side 262 of cover 260 and the shallow clip side is positioned on the second side 262 of cover 260.

The shallow clip portions of clips 275 and the deep clip portions of clips 275 positioned on the first side 262 of cover 260 may be attached to the existing sign 183 as previously disclosed above in relation to FIG. 15. A temporary sign may also be attached to the second side 263 of cover 260 which may include positioning the temporary sign 184 over the cover 260 with the deep clips 265 above the top edges adjacent the top portion of existing sign 183. The temporary sign 184 may then be pushed up so that the top deep clips 265 engage the top edges of temporary sign 184. The temporary sign 184 can be pushed up until the shallow clips 265 are positioned below the bottom edges of the temporary sign 184. The temporary sign 184 may then be moved downward until the bottom edges of the temporary sign 184 rest on the inside of shallow clips 266, retaining the temporary sign 184 in a position overlaying and covering the second side 263 of cover 260 (not shown). The shallow clips 266 bear the weight of the temporary sign 184 and the deep clips 265 secure the top portion of the temporary sign 184 to the second side 263 of the cover 260.

The cover 260 may be used for sign with multiple mountings including single post (post 242) or dual post (posts 243) as shown in FIG. 18. The securing means of the clips 275 to the cover 260 do not interfere with sign mounting and can be used with signs having different mounting, including single post and dual post.

Figure 19:
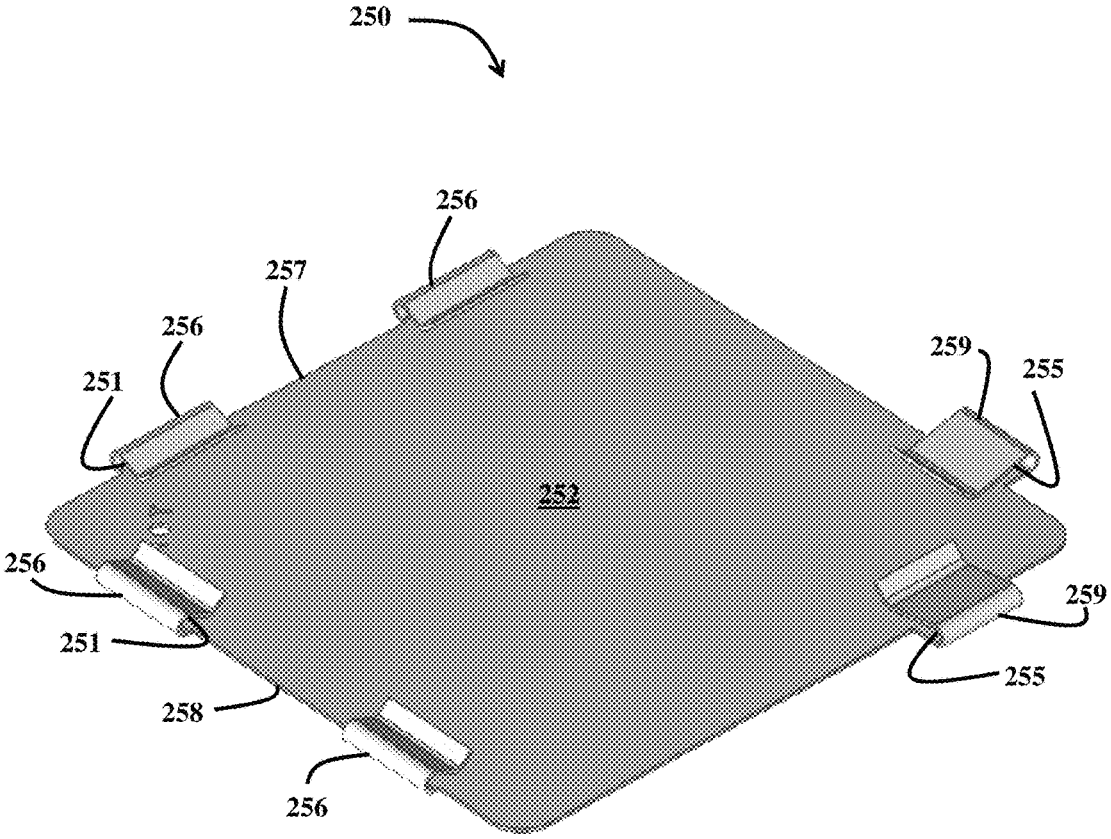
FIG. 19 is a perspective view of a traffic sign cover according to still a first embodiment of the present disclosure.

An alternative embodiment of a traffic sign cover 250 is illustrated if FIG. 19. The alternative cover 250 includes a first side 252, a second side 253 opposite first side 252, a first pair of holding members (e.g., shallow clips 256) integrally formed with the cover 250 on a first edge 257 on a top portion of the cover 250, a second pair of holding members (e.g., shallow clips 256) integrally formed with the cover 250 on a second edge 258 on the top portion of the cover 250, and a third pair of holding members (e.g., deep clips 255) attached to a bottom portion of the cover 250. The alternative cover 250 is sized and shaped to cover a side of an existing sign 183, for example, a sign having a corner rather than an edge at the highest point of the sign, although these types of clips may be used with alternate types of signs. The shallow clips 256 attached to top portion of the first side 252 of the cover 250 form spaces (e.g., slots 251) between the shallow clip 256 and first side 252 for receiving top edges of the existing sign 183 adjacent the top portion (not shown). The deep clips 255 attached to bottom portion of the first side 252 of the cover 250 form spaces (e.g., slots 259) between the deep clip 255 and first side 252 for receiving bottom edges of the existing sign 183 adjacent the bottom portion (not shown).

The installation of the cover 250 may include positioning the cover 250 over the existing sign 183 with the deep clips below the bottom edges of the existing sign 183. The cover 250 is then pushed up so that the bottom deep clips 255 engage the existing sign 183. The cover is pushed further up until the shallow clips 256 are positioned above the top edges of the existing sign 183. The cover 250 is then allowed to move down until the shallow clips 256 rest on the top edges adjacent the top corner of the existing sign 183, retaining the alternative cover 250 in a position overlaying and covering a side of the existing sign 183 (not shown). The shallow clips 256 bear the weight of the cover 250 upon the top edges of the existing sign 183, and the deep clips 255 secure the bottom portion of the cover 250 to the existing sign 183.

Although the clips depicted in FIGS. 15-18 are illustrated as being used with a diamond-shaped sign, clips may be used with covers attachable to any type of road sign, including with any other embodiments depicted herein.

FIG. 1 illustrates the general shape of a traffic sign cover 20 to be installed for a MUTCD R2-101, 70 mph speed limit sign. An illustrative size is 5.2 inches×4.2 inches and slot 32 and 33 thickness of about 0.25 inches. FIGS. 2-4 illustrates how the device is designed to cover the existing sign 43 while providing the option to house a temporary sign 44, for example, for the purposes of lowering the speed limit for a construction zone, for example, to 60 mph. The cover 20 may also be used solely to obstruct the existing sign from view by omitting the installation of the temporary sign 44. Alternatively, or additionally, the second side 23 can include sign markings, for example, markings for a temporary speed limit.

FIG. 6 illustrates a general shape of an alternative traffic sign cover 60 to be installed for a MUTCD W4-2R, Right Lane Ends sign. An illustrative size is 4.2 inches by 3.0 inches and slot 68 and 69 thickness of about 0.25 inches. FIGS. 7-9 illustrates how the device is designed to cover the existing sign and house a temporary sign 84 for the purposes altering existing traffic control conditions. For example, as shown in FIG. 9, traffic conditions were shifted from a W4-2R Right Lane Ends to a W-4-2L Left Lane Ends. The alternative cover 60 may also be used solely to obstruct the existing sign from view by omitting the installation of the temporary sign 84. The alternative cover 60 can optionally include only one of pocket 64 and guides 66 and/or one of pocket 65 and guides 67.

FIGS. 2-4 and 7-12 illustrate the covers 20, 60 as installed from the perspective of the MUTCD standard sign designations R2-101 and W4-2R. Standard hardware installation assemblies are shown to illustrate that the sign cover dimensions are such that the device can easily slide over the existing signs 43, 83 without blockage or interference from the hardware. Advantageously, no hardware is required to provide and retain the covers 20 and 60 and temporary signs 44 and 84 to form assemblies 40 and 80.

FIGS. 4 and 9 illustrate the covers 20, 60 for MUTCD standard signs R2-101 and W4-2R. These figures illustrate the symmetric nature of the design, which is intentional in order for the installer to slide the unit over the existing sign 43, 83 and place a temporary sign 44, 84 of the same size and shape.

The cover 20, 60 may be a semi-rigid plastic, for example, such as, polyethylene, or metal, polymer, composite, other material, or combination thereof that is designed to easily slide over a traffic sign and retain its shape in order to obstruct it from view.

The embodiments illustrated in FIGS. 1-5 may be used on non-vertical signs including diamond shaped signs as illustrated in FIGS. 7-9. In some cases the mounting hardware of the existing sign may interfere, in such cases other embodiments, such as the embodiments illustrated in FIGS. 6-19, may be used.

Although the illustrated embodiments include holding members (e.g., brackets, guides, or clips) to hold the cover to an existing sign and hold a temporary sign to the cover, alternate embodiments similar to those depicted in the drawings include holding members (e.g., brackets, guides, or clips) on one side of the cover permitting the cover to be attached to an existing sign, but no holding members on the other side of the cover. Alternate embodiments include sign covers with two or more different styles of holding members (e.g., brackets, guides, and clips) being used together with the same cover.

Reference systems that may be used herein can refer generally to various directions (e.g., upper, lower, forward and rearward), which are merely offered to assist the reader in understanding the various embodiments of the disclosure and are not to be interpreted as limiting. Other reference systems may be used to describe various embodiments, such as referring to the direction of projectile movement as it exits the firearm as being up, down, rearward or any other direction.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used in combination with some or all of the features of other embodiments as would be understood by one of ordinary skill in the art, whether or not explicitly described as such. One or more exemplary embodiments have been shown and described, and all changes and modifications that come within the spirit of the disclosure are desired to be protected.

What is claimed is:

1. A device for covering the information on an existing road sign, comprising:

a planar structure including a first side and a second side;

at least one first holding member configured to attach to the planar structure and form a first space configured to receive an existing road sign between the first holding member and the first side of the planar structure, wherein the at least one first holding member includes at least one narrow pocket clip attached adjacent a first edge of the planar structure and at least one deep pocket clip attached adjacent a second edge of the planar structure, and wherein the at least one first holding member holds the planar structure on the existing road sign when the first holding member is attached to the planar structure; and at least one second holding member configured to attach to the planar structure and form a second space configured to receive a temporary road sign between the second holding member and the second side of the planar structure, wherein the at least one second holding member holds the temporary road sign in a position that obscures the information on the existing road sign and makes viewable the information on the temporary road sign when the second holding member is attached to the planar structure.

2. The device of claim 1, wherein the first holding member includes at least two narrow pocket clips attached adjacent a top edge of the planar structure and at least two deep pocket clips attached adjacent a bottom edge of the planar structure.

3. The device of claim 1, wherein the first holding member and the second holding member are a single article body of unitary construction.

4. The device of claim 1, wherein the first holding member and the second holding member are separate members.

5. The device of claim 1, wherein the first holding member forms a pocket with the planar structure.

6. The device of claim 1, wherein the planar structure obscures the information on the existing road sign when the planar structure is held to the existing road sign.

7. The device of claim 1, wherein the first holding member is configured to support at least a portion of the planar structure and the temporary road sign.

8. A device for covering an existing road sign, comprising:

a base member including a first side and a second side;

at least one first holding member extending from the first side of the base member, wherein the at least one first holding member includes at least one narrow pocket clip attached adjacent a first edge of the base member and at least one deep pocket clip attached adjacent a second edge of the base member; and at least one second holding member extending from the second side of the base member;

wherein the first holding member is configured to receive an existing road sign and hold the base member on the existing road sign; and wherein the second holding member is configured to receive an alternative road sign and hold the alternative road sign in a position where the information on the alternative road sign is viewable in place of the information on the existing road sign.

9. The device of claim 8, wherein the first holding member includes at least two narrow pocket clips attached adjacent a top edge of the base member and at least two deep pocket clips attached adjacent a bottom edge of the base member.

10. The device of claim 8, wherein the first holding member forms a first pocket with the base member and the second holding member forms a second pocket with the base member.

11. A method of covering a sign, comprising:

coupling a rigid cover to a front surface of an existing road sign by placing the existing road sign in at least one first slot between the rigid cover and a first holding member, wherein the coupling further includes:

engaging at least one deep pocket clip attached to the rigid cover with a lower edge of the existing road sign;

moving the rigid cover upward until at least one narrow pocket clip attached to the rigid cover is positioned above an upper edge of the existing road sign; and moving the rigid cover downward until the at least one narrow pocket clip inhibits further downward movement of the rigid cover and the at least one deep pocket clip is engaged with the existing road sign;

obscuring a portion of the existing sign with the cover; and presenting at least one second slot between the rigid cover and a second holding member, the second slot configured to retain an alternative sign in front of the existing road sign for viewing.

12. The method of claim 11, further comprising:

coupling the alternative sign to the rigid cover, wherein the information on the replacement road sign can be viewed in place of the information on the existing road sign.

13. The method of claim 12, wherein said coupling the alternative sign to the rigid cover includes:

engaging at least one deep pocket clip attached to the rigid cover with an upper edge of the alternative sign;

moving the rigid cover upward until a lower edge of the existing road sign is positioned above at least one narrow pocket clip attached to the rigid cover; and moving the rigid cover downward until the at least one narrow pocket clip inhibits further downward movement of the rigid cover and the at least one deep pocket clip is engaged with the existing road sign.

* * * * *